US006283427B1

(12) United States Patent
Møller et al.

(10) Patent No.: US 6,283,427 B1
(45) Date of Patent: Sep. 4, 2001

(54) SUPPORTING MEANS OF A SCREENING DEVICE

(75) Inventors: Brent Møller, Gentofte; Torben Holst Nielsen, Rødovre; Carsten Brønnum Grinvalds, Albertslund; Gert Godvig Lassen, Skjern, all of (DK)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 09/380,296

(22) PCT Filed: Aug. 12, 1998

(86) PCT No.: PCT/DK98/00349

§ 371 Date: Aug. 31, 1999

§ 102(e) Date: Aug. 31, 1999

(87) PCT Pub. No.: WO99/07974

PCT Pub. Date: Feb. 18, 1999

(30) Foreign Application Priority Data

Aug. 12, 1997 (DK) ..... 0927/97

(51) Int. Cl.[7] ..... A47H 1/10

(52) U.S. Cl. ..... 248/266; 160/903; 248/268; 248/264; 248/252

(58) Field of Search ..... 248/266, 261, 248/252, 264, 268, 316.8, 231.9, 310, 205.1, 214, 215; 211/87.01; 160/323.1, 326, 903; 403/381, 331

(56) References Cited

U.S. PATENT DOCUMENTS 1,635,700 * 7/1927 Bigelow ..... 248/268
3,614,045 10/1971 Cegielski .
3,738,650 * 6/1973 Ossenkop et al. ..... 482/40
4,473,225 * 9/1984 Miller ..... 482/40

FOREIGN PATENT DOCUMENTS 30 48 333 7/1982 (DE) .
33 30 472 A 3/1985 (DE) .
0 465 433 A 1/1992 (EP) .
2 032 498 A 5/1980 (GB) .
415 904 11/1980 (SE) .
WO 96 07007 3/1996 (SE) .

* cited by examiner

*Primary Examiner*—Anita King
*Assistant Examiner*—Holly N. Sy
(74) *Attorney, Agent, or Firm*—Venable; John P. Shanon; Chad C. Anderson

(57) ABSTRACT

A supporting mechanism for a window screening device comprises a first pair of bracket members for mounting on each of a pair of opposed parallel frame surfaces of the frame structure and a second pair of coupling members engageable by the screening device. Each bracket member and each coupling member comprises an engaging mechanism for releasable sliding engagement of a coupling member with a bracket member. Each bracket member or each coupling member is provided with a resilient mechanism engageable with an abutment of a coupling member or a bracket member to retain the bracket member and the coupling member in mutual engagement. The bracket members are identical standard members each comprising a relatively flat front part protruding from said frame surface and having a substantially smooth external surface and engaging mechanism formed by a pair of opposed parallel side edges. Each coupling member is formed as a substantially flat brick-shaped member provided with an open recess limited by leg portions forming engaging mechanism engageable with the engaging mechanism on the bracket members.

16 Claims, 3 Drawing Sheets

SUPPORTING MEANS OF A SCREENING DEVICE

FIELD OF THE INVENTION

The present invention relates to means for supporting a screening device in a frame structure with frame members comprising top and bottom members as well as side members and lining an opening in a building, in particular a door or a window, said means comprising a first pair of bracket members for mounting on each of a pair of opposed parallel frame surfaces of said frame structure and a second pair of coupling members each provided with means engageable by engaging means on said screening device, each of said bracket members and each of said coupling members further comprising engaging means for releasable sliding engagement of a coupling member with a bracket member, each member of one of said first and second pairs being provided with resilient means engageable with abutment means of a member of the other pair to retain a bracket member and a coupling member in mutual engagement.

BACKGROUND OF THE INVENTION

Screening devices for windows and doors such as roller blind, venetian blinds, pleated blinds and internal and external shutters are conventionally supplied together with supporting brackets which are specifically adapted to the particular form of screening device and are engageable by engaging means provided on the screening device, typically at either end thereof. During installation of the screening device the supporting brackets must be mounted by the user himself which frequently results in errors, in particular if different left-hand and right hand brackets are mixed up.

Although it is also known to incorporate supporting brackets for a specific type of screening devices in the frame structures of doors and windows during the production thereof, so that the door or window frame structure is supplied with premounted supporting brackets, such brackets have normally been designed for use with a specific kind of screening devices such as roller blinds. If installation of another kind of screening device such as a venetian blind is desired, then it has been necessary in such case to replace the premounted supporting brackets with brackets specifically designed for the desired screening device.

In addition, unavoidable production tolerances for the door or window frame structure may result in difficulties with respect to correct mounting of a screening device, whereby safe mounting of a screening device to the frame structure may occasionally only be obtained by use of additional fastening screws.

In DE patent no. 30 48 333 supporting means for a roller blind is disclosed comprising two support plates, one of which is provided with a slot for receiving a square pin in one end of the spring roller tube of the roller blind in a rotationally locked manner and the other one is provided with a circular hole. For alternative mounting of a Venetian blind, each support plate is provided with protrusions for engaging grooves in coupling members connected with the top casing of the Venetian blind, said members being pushed over the support plates. Subsequently, the side guide lists of the blind are mounted, said lists serving simultaneously as support for the coupling members and the top casing of the blind, i.e. as a safety against disconnection of the coupling member from the support plate.

Although this support arrangement allows for use of the same supporting brackets for different screening devices, a disadvantage of this design has been that for use with a roller blind supporting brackets of different design for receiving the spring roller tube of the roller blind, i.e. the slot and the circular hole, respectively, are required.

In U.S. Pat. No. 3,614,045 a supporting arrangement is disclosed comprising elongate slotted rails secured to the side members of the frame structure and extending throughout the height thereof and coupling members provided with hook-shaped engaging members to engage in slots of said rails and projecting at right angles in front of the frame structure. The less attractive appearance of this arrangement limits its application to draperies, which will hide the supporting arrangement, and does not qualify to meet current demands for an aesthetical and functional design of windows and accessories like screening devices.

EP-A1-0,465,433 discloses an arrangement comprising a pair of identical tubus-shaped supporting brackets secure to opposed surfaces of frame side members, in each of which a transverse recess is formed to receive a resilient clamping member of a form restoring the outer cylindrical form of the supporting brackets. This design is intended only for roller blinds having engaging means in the form of projecting cylindrical pins at either end.

WO 96/07007 discloses a roller shade mounted between a pair of supporting brackets projecting at right angles from the front side of the frame structure and formed with an undercut groove to receive a coupling member in the form of a slide engaged by the roller shade.

In SE-B-415,904 a roller blind support is disclosed comprising a pair of L-shaped bracket members in which edge flange portions on either side of a rectangular slit are engaged by resilient legs of an insert slide which can be pushed into the recess and is engageable by engaging means on the roller blind.

SUMMARY OF THE INVENTION

On this background it is the object of the invention to provide supporting means for mounting a screening device in a rectangular frame structure lining a building opening, preferably on the frame or sash structure of a window, which has an attractive design meeting modern days user demands with respect to design quality and is easy and cheap to manufacture and the installation of which is simplified by a self-aligning design that may to a large extent compensate for production tolerances.

An additional object is to provide a standard design of the first pair of supporting brackets which can be premounted on the frame structure at the production site whereby simple installation of a variety of screening devices using various forms of coupling members is made possible.

According to the invention these objects are met by supporting means as identified above, characterized in that the bracket members of said first pair are identical standard members for mounting on said opposed frame surfaces, each comprising a relatively flat front part protruding from said frame surface in the mounted position of said bracket member and having a substantially smooth external surface, said engaging means being formed by a pair of opposed parallel side edges of said front part, and that each coupling member is formed as a substantially flat brick-like member provided with an open recess limited by at least one leg portion forming engaging means engageable with said engaging means on the bracket members.

By forming the bracket members as identical standard members the production thereof will become simple and cheap. The bracket members may typically be mounted on opposed surfaces of the sash or frame side members facing the light area of a window and immediately below the top member of the sash or frame. Alternatively, the bracket members may also be mounted, however, on opposed surfaces of the sash or frame top and bottom members for accommodation of screening device which is movable in the horizontal direction. Moreover the bracket members may be mounted with the pair of opposed parallel side edges of the front part forming the engaging means for the coupling members extending either in the longitudinal direction of the frame or sash members on which they are mounted or transversely thereto. By the latter orientation the subsequent mounting of the coupling members on the bracket members becomes particularly simple, since the coupling members may be pushed onto the bracket members from the internal side of the window in a direction at right angles to the plane of the window pane.

In one preferred embodiment of the supporting means the front part of each bracket member is formed with a curved convex front wall engageable with a wall part of said coupling member. said resilient means being formed by one of said front wall of the bracket member and said wall part of the coupling member. Thereby, the resilient means is physically separated from the engaging means of the bracket member and the coupling member, and the resilient action of the resilient means will act in a direction perpendicular to the opposed frame or sash surface on which the bracket members are mounted. Thereby, the resilient function will act to enable snap engagement between the bracket member and the coupling member and provide a kind of floating suspension to compensate for production tolerances.

In one design of the above-mentioned preferred embodiment the front part of each bracket member comprises a base section forming a flat abutment surface against said frame surface and being connected with said front wall along said pair of opposed side edges, side edges of said base section being retracted from said opposed side edges to form edge flanges providing said engaging means.

Thereby, mounting of the bracket members on the opposed frame or sash surfaces can easily be accomplished by providing the base section with appropriate fastening means.

In another, preferred design each bracket member comprises a socket-like member for mounting in a blind hole in said frame surface and providing a slit-like duct, said front part being formed as a substantially T-shaped spring member having a leg engageable in said duct and projecting curved spring members forming said front wall and providing said engaging means.

For the accommodation of a screening device incorporating electrical drive means an advantageous embodiment of the supporting means of the invention provides the additional feature that at least one of the bracket members and at least one of the coupling members are provided with electrical contact means to form part of an electrical supply line for such electrical drive means.

Given the possibility of premounting of the bracket members at the production site the invention further relates to a skylight window for installation in an inclined roof surface and comprising a substantially rectangular frame structure composed of parallel top and bottom members as well as parallel side members. According to the invention such a window may be prepared for subsequent installation of a screening device by securing a pair of identical bracket members to opposed surfaces of said side members to permit mounting of said screening device.

A screening device prepared for installation in a door or window frame structure may according to the invention be supplied as a screening device assembly which further comprises the coupling members of the supporting means, said coupling members being designed for engagement with the particular form of screening device like roller blinds, venetian blinds, pleated blinds, shutters or the like.

BRIEF DESCRIPTION OF THE DRAWINGS

The invention will be described in the following with reference to the schematic drawings, in which.

DETAILED DESCRIPTION OF THE PREFERRED EMBODIMENTS

Figure 1:
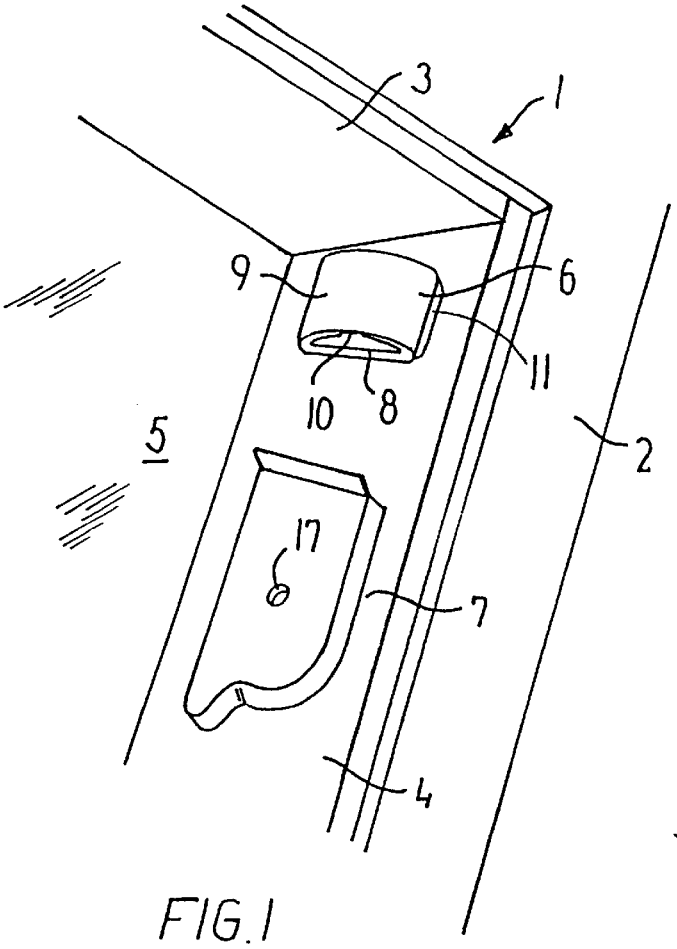
FIG. 1 is a perspective view of a skylight window provided with an embodiment of supporting means for a screening device.

FIG. 1 shows the upper right-hand corner of a window with a frame structure with a top member 1 and a side member 2. The frame structure will conventionally comprise a further side member and a bottom member, not shown in the figure. In the frame structure a sash structure is hingedly supported, said sash structure comprising a top member 3 and a right-hand side member 4, which together with a left-hand side member and a bottom member, not shown, frame a window pane 5.

With a view to mounting a screening arrangement at the interior side of the window pane 5, a bracket member 6 has been secured to the side member 4 of the sash close to the top member 3, said bracket member constituting one of a pair of bracket members comprising two substantially identical standard members, the other of which is mounted on the opposite left-hand sash side member. In connection with a screening arrangement (not shown), which in the following will be referred to as a roller blind, a coupling member 7 forming one of a pair of coupling members is provided to be brought into engagement with the bracket member 6 in a manner which will be described in the following.

Figure 5:
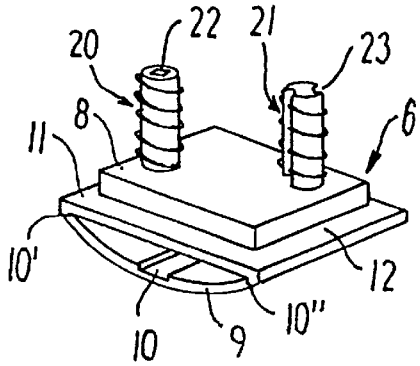
FIG. 5 is an enlarged perspective view of a further development of the bracket member shown in FIG. 2.

The bracket member 6 comprises a base section 8, which in the embodiment shown is designed as a plate which may be secured to the sash side member 4 by securing means as shown in FIG. 5 provided on the side facing the sash side member. The base section may otherwise be designed as a plate with plane-parallel surfaces or surfaces which intersect one another at a given angle and form a wedge-shape, or be designed as a plate divided in two, one part of which forming the base of a resilient section, and the other one the securing means.

Figure 2:
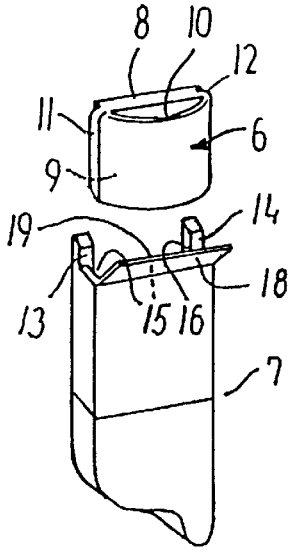
FIG. 2 is a perspective view of the bracket and coupling members in another embodiment.

On the opposite side, the base section is provided with a front part formed with a convex curved front wall 9, which as shown may be designed as a segment of a cylindrical surface, but may also be formed as a segment of other advantageous geometric surface types, like for instance spherical, elliptic or parabolic ones. As shown in FIG. 5, the front wall 9 may be provided with one or more weakening zones 10, 10', 10" of smaller thickness to facilitate resilient spring action and ensure that the front wall may be pressed down as shown in FIG. 2 with a centrally positioned weakening zone 10 of less thickness. Another possibility would be to provide the front wall 9 with a slot, for instance near the transition between the front wall and the base section, following which pressing down of the front wall would cause a displacement rather than a compression thereof. At the transition between the resilient front wall and the base section the bracket member 6 may, as shown, be provided on each side with a shoulder portion 11, 12 extending in the longitudinal direction of the side member 4.

As most distinctly shown in FIG. 2, the coupling member 7 may have a substantially U-shaped cross-section forming an open substantially rectangular recess limited by legs 13, 14, each forming an inwards facing track 15, 16, said legs defining a wall part 19, which in the mounted condition of the supporting means extends in a plane approximately perpendicular to the plane of the pane and parallel to the sash side member 4. In the embodiment shown, the coupling member 7 is provided with a circular hole 17 for receiving for instance a suspension pin at one end of the spring roller tube of the roller blind.

Figure 4:
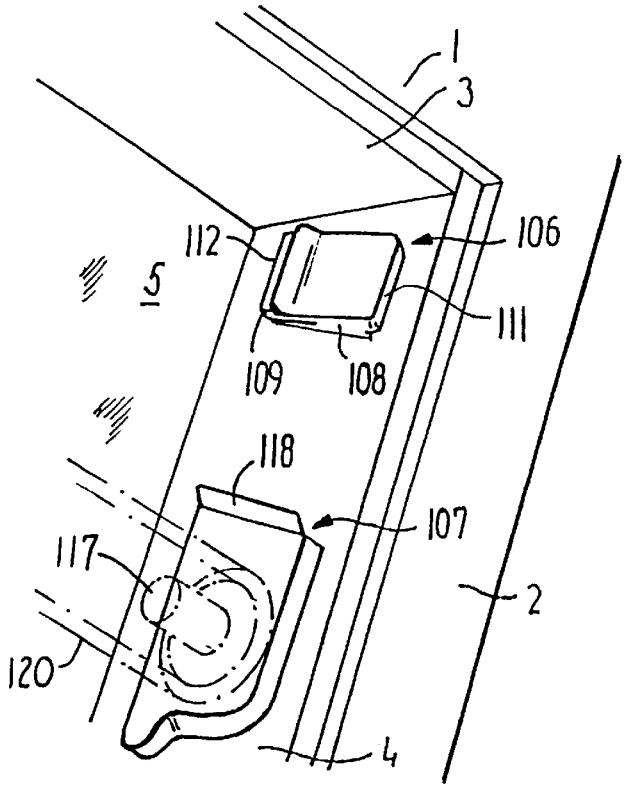
FIG. 4 is a perspective view corresponding to FIG. 1 of an alternative embodiment of the supporting means according to the invention.

Whereas the members of the first pair of bracket members have a substantially identical design, the members of the second pair of coupling members may be designed differently depending on the screening arrangement. Thus, the left-hand coupling member (not shown) may be provided with means for receiving, in a rotationally locked manner, a second suspension pin in the opposite end of the spring roller tube. In another embodiment, the coupling member 7 may, as shown in FIG. 4, be provided with a pin which may engage a suspension member on the spring roller tube.

Alternatively, the resilient section may comprise two parts, one of which is a spring part connected at one end with the base section and at the other with a contact part intended for engagement with the wall part of the coupling member. The contact part may be part-cylindrical in cross-section and have means for connection with the base section.

The bracket and coupling members may in themselves be manufactured from commonly used materials, i.e. various types of plastics, metals and composites, which materials may also be reinforced, dyed, painted, etc. The pairs of bracket and coupling members may further be composed by different types of materials, if it is desired to obtain certain characteristics in respect of the individual parts. The base section 8 of the bracket member 6 may for instance be manufactured from plastic and the front wall 9 from metal.

As an alternative, the bracket member may consist entirely of a resilient material, e.g. a rubber compound, or of a rubber part constituting the resilient section in connection with a base section of a rigid plastic material.

Figure 7:
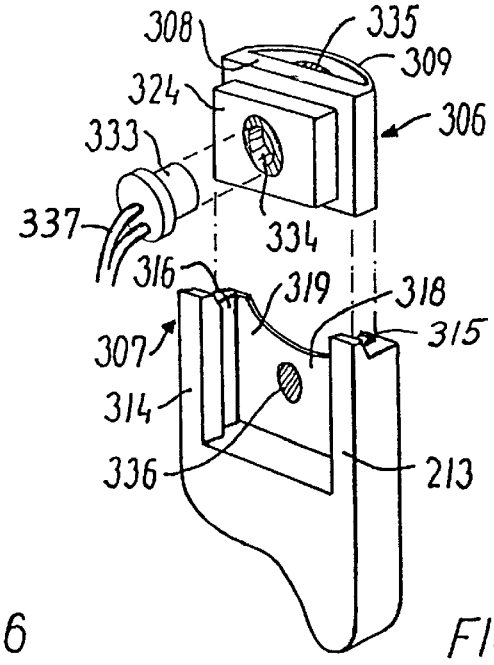
FIG. 7 is a perspective view of a still further embodiment comprising a bracket member forming part of an electrical supply line for an electrically operated screening device.

At the mounting, the roller blind is brought into position parallel with the top member 3 of the sash and with the members of the second pair of coupling members positioned outside and a little below the members of the first pair of bracket members. Each coupling member 7 is now pushed over the corresponding bracket member 6. During this operation, a flap 18 projecting obliquely from the coupling member 7 presses the curved front wall 9 of the bracket member 6 slightly inwards, following which shoulder portions 11, 12 of the bracket member 6 engage the tracks 15, 16 of the coupling member 7. The flap 18 thus constitutes a means for facilitating the engagement between the members of the two pairs of bracket and coupling members. As an alternative, such facilitating means may be constituted by an incision in the wall part of the coupling member as shown in FIG. 7. Such an incision may have a semi-circular or polygonal shape. Thereby, the height of the supporting means may be reduced, as the engagement between the coupling member and the bracket member is first established at the sides of the resilient section and only subsequently, when the resilient section has been compressed and the height thereof is thus reduced, in the central portion of the resilient section and the wall part of the coupling member. A controlled deformation of a resilient section may be ensured by means of one or more weakening zones 10, 10', 10", a requirement being that the total width of the bracket member 6 is kept substantially constant in view of establishing a kind of floating suspension, the resilient section being movable to accommodate for tolerances and at the same time preventing the shoulder portions 11, 12 from sliding sideways out of the tracks 15, 16.

Figure 3:
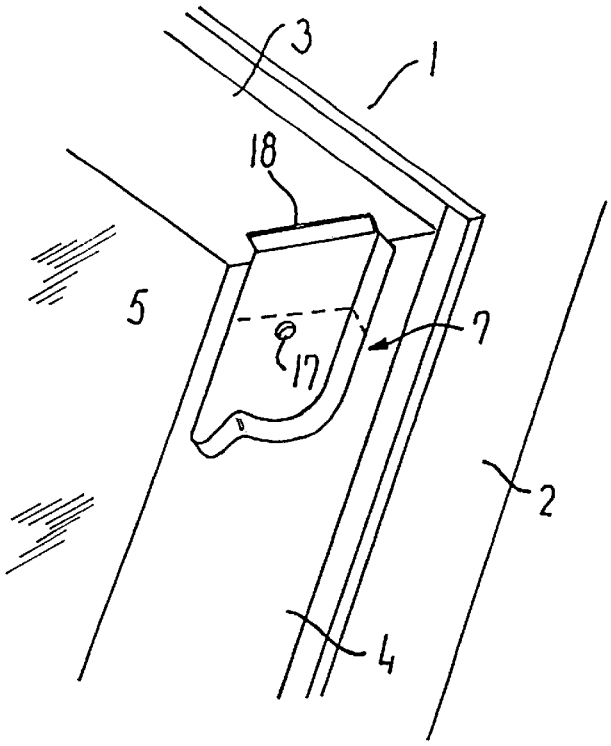
FIG. 3 is a perspective view of the supporting means shown in FIG. 1 in assembled condition.

The coupling member 7 is displaced together with the roller blind (not shown) to the position shown in FIG. 3, in which snap means in the form of for instance a projection (not shown), which is placed on the wall portion of the side of the coupling member 7 facing the bracket member 6 close to the projecting flap 18 has passed the upper edge of the front wall 9 which may thus move outwards into abutment against the interior side of the wall part of the coupling member 7 positioned between the legs thereof. The projection now abuts on the upper edge of the front wall 9 and supplements the force from the resilient section pressing against the interior side of the wall portion part 19 of the coupling member positioned between the legs thereof.

As further seen from FIG. 3, the hole 17 of the coupling member 7 for receiving the spring roller tube is in this position placed below the bracket member 6, so that the spring roller tube does not get in contact with the resilient front wall 9.

In the embodiment shown in FIG. 4 the main difference from the embodiments described above is that the resilient section is designed as a curved tongue 109, which may be formed as a segment of a cylindrical, spherical, elliptic or parabolic surface and extends convexedly from the base section 108. The bracket member 106 includes shoulder members 111 and 112. The mounting of the roller blind indicated with dashed lines takes place substantially as described above, and members with similar or analogous function are referred to with the same reference numbers as in the embodiment described above, only 100 has been added. In stead of the circular hole 17 the coupling member 107 is provided with a cylindrical pin 117 to engage a mating hole or bore in the spring roller tube 120 of the roller blind. The flap 118 constitutes means for facilitating the engagement between the coupling and bracket members and corresponds in function to flap 18 of the above embodiments.

The curved tongue 109 is so resilient that it can be bent into a position, in which it allows access to a screw hole, if it is desired to mount the bracket member by screw means of the securing means described in the following.

FIG. 5 shows a modification of the securing means on the rear side of the bracket member. Two pins 20, 21 are designed with an exterior thread and have an interior cavity, for instance in the form of a hole 22 and two grooves 23. At the mounting of the bracket member 6, the pins 20, 21 are taken into predrilled holes in the sash side members 4, and the member 6 is subsequently pushed into place. This mounting is preferably performed in connection with the manufacture of the sash structure, such that the window is delivered with a pre-mounted first pair of bracket members.

When it is desired to dismount the roller blind, the resilient front wall 9 of the male member is pressed in with a suitable tool, following which the coupling member 7 is displaced downwards along the sash side members 4 and removed together with the roller blind. It is now possible to mount a new screening arrangement on the existing bracket members. It should be noted that if the bracket member 6 has been damaged, the base section and the resilient front wall are first removed, following which the pins placed in the bores in the sash side members may be unscrewed with a suitable tool, for instance a tool mating the interior hole 22 of the pins or the exterior grooves 23.

The mounting of the screening arrangement may also be performed in a direction at right angles to the longitudinal direction of the side members, the bracket and coupling members being turned 90°.

Figure 6:
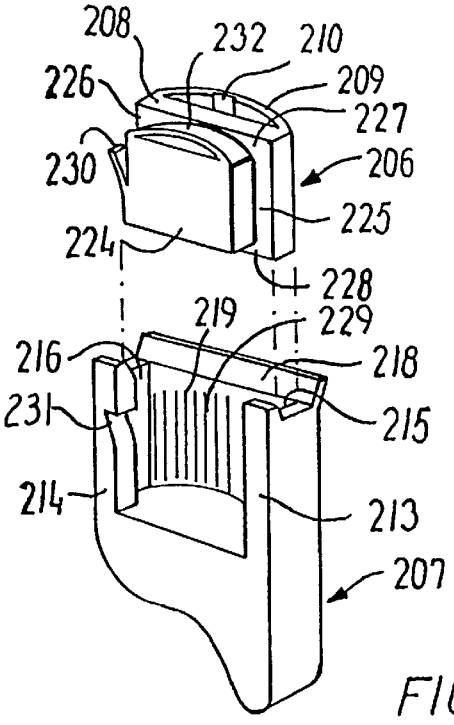
FIG. 6 is a perspective view of another embodiment of the bracket and coupling members of the supporting means according to the invention.

In FIG. 6 an embodiment is shown, in which the bracket member 206 is specifically designed for mounting of a screening arrangement from the front side, i.e. in a direction at right angles to the longitudinal direction of the sash side members. For that purpose the base section 208 of the bracket member 206 is provided with a rearward plate member 224 having smaller dimensions than the remaining part of the base section and adapted to allow the plate member 224 to be received between the legs 213, 214 on the coupling member 207. In this way, two pairs of mutually oppositely positioned shoulder portions are formed, 225, 226 and 227, 228, respectively, for engagement with the tracks 215, 216 of the female member as described in detail in the following.

The shoulder portions 225, 226 correspond to the shoulder portions 11, 12 and 111, 112 in the embodiments described above and are thus adapted to be brought into engagement with the coupling member 207 at the mounting of the screening arrangement in a direction parallel to the longitudinal direction of the sash side members, whereas the shoulder portions 227, 228 serve as engagement means during the pushing on of the coupling member 207 at right angles to the longitudinal direction of the sash side members.

As further shown in FIG. 6 the engagement of the coupling member 207 with respect to the bracket member 206 may be reinforced by snap engagement means. In the coupling member 207 the wall part 219 between the two legs is designed with a cavity, which is defined by an arcuate wall 229 having a shape substantially complementary to the resilient front wall 209 of the bracket member 206. As an alternative, front wall 209 may be provided with a weakening zone 210. The weakening zone 210 corresponds in function to the weakening zone 10 of the embodiments above. In addition, the bracket member 206 is provided with a tongue 230 projecting from the plate member 224 at the shoulder portion 226, said tongue constituting a further resilient section for engaging a recess 231 in one of the rails 214 of the coupling member at the end of one of the legs thereof. During the pushing on of the coupling member 207 this tongue 230 will be pressed against the plate member 224 by the rail 214 and thus allow passage of the coupling member over the bracket member, until the tongue 230 can move outwards and into the recess 231, whereby a locking function is provided. Then the coupling and bracket members will be locked relative to each other and a safe securing of the screening arrangement is thus obtained. The flap 218 constitutes means for facilitating the engagement between the coupling and bracket members and corresponds in function to flap 18 of the above embodiments.

As supplemental securing means between the coupling and bracket members during mounting of the screening arrangement from the front side, an arcuate wall 232 may be provided on the plate member 224 of the bracket member 206 at the shoulder portion 227, said wall being adapted like the front wall 209 for releasable engagement with a wall part of the U-shaped coupling member 207, i.e. the interior side of one of the legs thereof.

In FIG. 7 an embodiment is shown, in which the resilient engagement between the bracket and coupling members 306, 307 of the first and second pairs is used to establish an electrically conductive connection between contact means 333 arranged in connection with wiring means 337 from a power supply source in the sash structure, and an electrical drive unit in the screening arrangement with a view to electrical operation thereof. The coupling member includes rails 313, 314 and plate member 324. The contact means 333 is formed substantially as a cylindrical pin member received in an opening 334 in the base section 308 of the bracket member 306 and may thereby also function as a guide and stop pin for the movement of the front wall 309 with respect to the base section 308. Opposite the opening 334 a first zone 335 of the front wall 309, which constitutes the resilient section, is made of an electrically conducting material and extends throughout the width of the front wall 309. In the wall part 319 of the coupling member 307, a second zone 336 of an electrically conducting material is provided to provide contact between the first zone 333 and contact means for the electrical drive unit in the screening arrangement in the mounted position of the latter.

At the mounting of the screening arrangement the coupling member 307 is, in the manner described above, pushed over the bracket member 306. Thereby the front wall 309 is pressed inwards in a direction towards the base section 308 and, in the assembled condition, the second zone 336 is positioned in contact with the first zone 335, which has been premounted at the manufacturing stage in contact with the contact and wiring means 333 and 337 in the sash structure, to complete the electric connection between the power supply source and the electrical drive unit of the screening arrangement.

In the embodiment shown in FIG. 7 the wall part 319 of the coupling member 307 is formed with a substantially semicircular incision 318 to substitute the projecting flap of the embodiments in FIGS. 1 to 6 as a means for facilitating the engagement between the coupling and bracket members.

Figure 8:
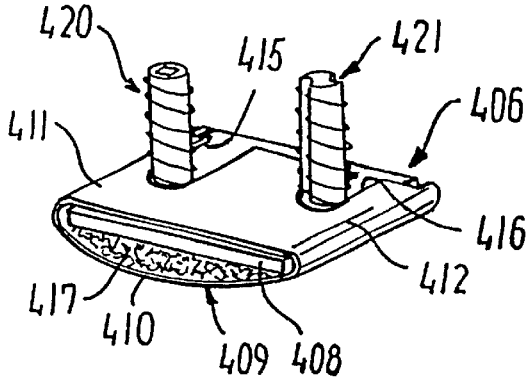
FIG. 8 shows a modification of the bracket member shown in FIG. 5.

FIG. 8 shows a modification of the bracket member shown in FIG. 5. In this bracket member 406, the curved convex front wall 409 is provided by a metallic member 410 formed substantially as a leaf spring with end parts 411 and 412 wrapped around the base section 408 and positioned between raised edge ribs from the rear side of the base section 408. In the end parts 411 and 412 incisions or cut-outs 415 and 416, respectively, are provided to accommodate the two pins 420 and 421 which may be of the same design as described above for the embodiment in FIG. 5. In the cavity between the curved front wall 409 and the base section 408 a filling 417, e.g. of a compressible foam material may be provided.

In this embodiment which offers the advantage of simplicity in structure and manufacture the metallic leaf spring member 410 will in use together with any of the coupling member embodiments 7, 107, 207 and 307 described above produce a resilient engagement action both against the wall part 9, 109, 209 and 309 and against the bottom of the tracks 15, 16, 215, 216 and 315, 316 to produce a stable and reliable engagement of the coupling member with respect to the bracket member.

Figure 9:
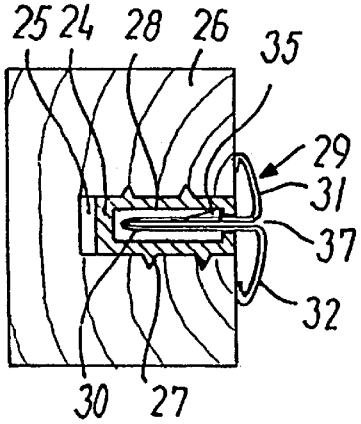
FIG. 9 is a sectional view of a further embodiment of the bracket member secured to a frame or sash member of a window.
Figure 10:
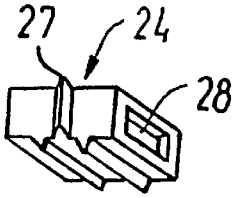
FIGS. 10 and 11 are perspective views of components of the bracket member shown in FIG. 9.
Figure 11:
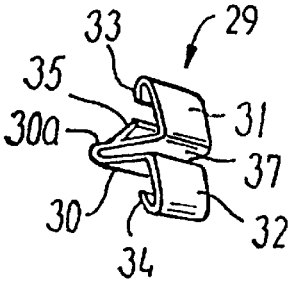

In FIGS. 9 to 11 another preferred embodiment of the bracket member is shown which in this case comprises as one part a socket-like member 24 which as shown in FIG. 9 is mounted in a blind hole 25 in the frame surface provided by a sash side member 26. The socket member 24, which may be of generally rectangular box-like shape is provided with protruding ribs 27 on its external surfaces to provide a stable engagement with the walls of the blind hole 25. The socket member 24 which is typically a moulded plastics member, e.g. of nylon or a similar material, is formed with an internal cavity in the form of a relatively narrow slit-like duct 28. Another part of the bracket member comprises a front part in the form of a substantially T-shaped metallic spring member 29 having a leg 30 which is engageable in the duct 28 and is formed integrally with projecting curved spring elements 31 and 32 forming the resilient front wall of the bracket member. Each of the projecting spring elements 31 and 32 is formed at its external edge with an inwardly bent edge part 33 and 34, respectively, forming engaging means for the coupling member to be described below.

As most clearly depicted in FIG. 11 the T-shaped spring member 29 is formed of one piece from sheet metal, e.g. steel, and with a projecting engagement flap 35 stamped out from one wall 30*a* of the double-walled leg member 30.

Figure 12:
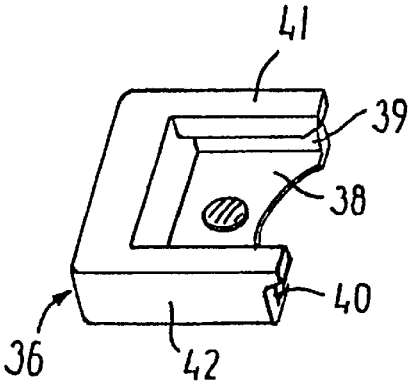
FIG. 12 is a perspective view of a coupling member for use with the bracket member shown in FIGS. 9 to 11, and FIGS. 13 and 14 are a sectional and a perspective view, respectively, of a modification of the bracket member shown in FIG. 9 secured to a frame or sash member of a window.

The coupling member 36 shown in FIG. 12 intended for use with the bracket member shown in FIGS. 9 to 11 correspond in its essential features to the embodiment shown in FIG. 7. In the mounting operation the coupling member 36 is pushed over the projecting spring elements 31 and 32 of the spring member 29 in direction parallel to the slit 37 formed by the double-walled leg 30 between spring elements 31 and 32. Thereby, the projecting spring elements 31 and 32 will provide a resilient engagement with the wall part 38 of the coupling member and, through the bent-in edge parts 33 and 34, also with the tracks 39 and 40 formed in the legs 41 and 42 of the coupling member.

Whereas in FIG. 9 the bracket member composed of socket member 24 and spring member 29 is mounted in the sash side member 26 with an orientation such that the edge parts 33 and 34 of spring elements 31 and 32 extend parallel to the longitudinal direction of the sash side member for mounting the screening arrangement with the same direction of pushing the coupling member over the bracket member, it goes without saying that the bracket member may also in this embodiment be turned 90° with respect to the sash side member to allow in front mounting of the screening arrangement as described above.

Figure 13:
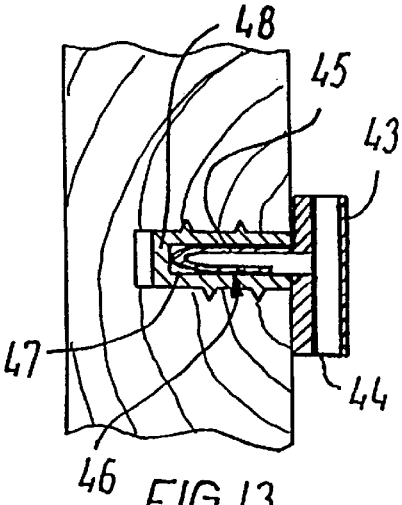
Figure 14:
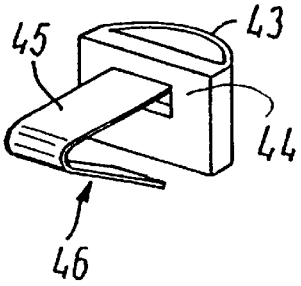

For the direction of mounting parallel to the longitudinal direction of the sash side member a particular advantageous design of the bracket member is shown in FIGS. 13 and 14, in which a front part 43 and a base section 44, e.g. of the same design as the bracket member 6 in FIGS. 1 and 2, is connected with one leg 45 of a double-legged spring member 46 for engagement with the slit-like duct 47 of a socket-like member 48 as shown in FIG. 9.

Due to the spring action of the double-legged member 46, the base section 44 and with it the front part 43 of the bracket member to be engaged by the coupling member supplied with the screening arrangement will be pushed upwards in the longitudinal direction of the sash side member towards the top member of the sash structure. Thereby a self-alignment and close-fit arrangement of a screening device against the top member of the sash structure may be obtained by means of an appropriately designed coupling member to provide for an optimum lightproofness of the screening arrangement.

Although the bracket and coupling members of the supporting means according to the invention have been shown and described above to be mounted on the sash structure, it should be understood that they might as well be mounted on the frame structure.

Moreover, whereas the screening arrangement has generally been described as a roller blind, the supporting means of the invention can be used for any kind of screening arrangement with an appropriate design of the coupling members to be supplied with the screening arrangement.

Whereas, in the embodiments shown and described above the resilient means of the supporting means retaining each coupling member in stable engagement with the corresponding bracket member has been described as part of the bracket member, such resilient means could alternatively be made part of the coupling member, e.g. by forming the wall part of the coupling member engaging the front wall of bracket member as a resilient member.

The coupling member need not necessarily be provided with engaging means at two opposed and parallel leg portions on either side of the open recess, with which it is pushed over the bracket member. In particular, when engaging means with a locking function as shown in FIG. 6 is used for a direction of mounting of the screening device at right angles to the longitudinal direction of the sash side member engaging means formed by a single leg porion may suffice for safe retainment of the coupling member with respect to the bracket member.

What is claimed is:

1. Supporting means for supporting a screening device in a frame structure with frame members comprising top and bottom members (1) as well as side members (2, 26) and lining an opening in a building, in particular a door or a window, comprising: a first pair of bracket members (6; 106; 206; 306; 406; 24, 29) for mounting on each of a pair of opposed parallel frame surfaces (2, 26) of said frame structure and a second pair of coupling members (7; 107; 207; 307; 36) each provided with first engaging means (17; 117) engageable by engaging means on said screening device (120), each of said bracket members (6; 106; 206; 306; 406; 24, 29) and each of said coupling members (7; 107; 207; 307; 36) further comprising second engaging means (11–16; 111–116; 33–34; 39–42) for releasable sliding engagement of one of said pair of coupling members with one of said pair of bracket members; each member of one of said first and second pair being provided with a resilient member (9; 109; 209; 309; 409; 31, 32) engageable with an abutment (19; 219; 319; 38) of a member of the other of said first and second pairs to retain a bracket member and coupling member in mutual engagement, characterized in that the bracket members (6; 106; 206; 306; 406; 24, 29) of said first pair are identical standard members for mounting on said opposed frame surfaces (2, 26), each comprising a relatively flat front part protruding from said frame surface (2, 26) in the mounted position of said bracket member and having a substantially smooth external surface, said second engaging means (11–12; 111–112; 33–34) being formed by a pair of opposed parallel side edges of said front part, and that each coupling member (7; 107; 207; 307; 36) is formed as a substantially flat brick-shaped member provided with an open recess limited by at least one leg portion (13–14; 113–114; 313–314; 41–42) forming engaging means (15–16; 215–216; 315–316; 39–40) engageable with said engaging means on the bracket members.

2. Supporting means as claimed in claim 1, characterized in that said resilient members (9; 109; 209; 309; 409; 31, 32) is incorporated in said front part of each bracket member (6; 106; 206; 306; 406; 24, 29).

3. Supporting means as claimed in claim 2, characterized in that said front part of each bracket member (6; 106; 206; 306; 406; 24, 29) is formed with a curved convex front wall (9; 109; 209; 309; 409; 31, 32) for abutment with a wall part (19; 219; 319; 38) of said coupling member, said resilient members (9; 109; 209; 309; 409; 31, 32) being formed by one of said front wall of the bracket member and said wall part of the coupling member.

4. Supporting means as claimed in claim 3, characterized in that said front part of each bracket member (6; 106; 206; 306; 406; 24, 29) comprises a base section (8; 108; 208; 308; 408) forming a flat abutment surface against said frame surface (2) and connected with said front wall along said pair of opposed side edges (11–12; 111–112), side edges of said base section being retracted from said opposed side edges to form edge flanges providing said engaging means, each coupling member (7; 107; 207; 307; 36) having engaging means formed by opposed parallel leg portions limiting said open recess.

5. Supporting means as claimed in claim 4, characterized in that at least one side edge (224) of the base section and at least one leg portion (214) of each coupling member is provided with mutually engageable locking means (230, 231).

6. Supporting means as claimed in claim 4, characterized in that said base section (8, 408) is provided with securing members (20, 21; 420, 421) for securing said bracket member (6, 406) in one of said opposed frame surfaces (2).

7. Supporting means as claimed in claim 3, characterized in that each bracket member comprises a socket-like member (24) for mounting in a blind hole (25) in said frame surface (26) and providing a slit-like duct (28), said front part being formed as a substantially T-shaped spring member (29) having a stem (30) engageable in said duct.

8. Supporting means as claimed in claim 7, characterized in that said stem is formed as a double-legged member with two leg parts integrally connected with projecting curved spring elements (31, 32) forming said front wall and providing said engaging means (33, 34).

9. Supporting means as claimed in claim 7, characterized in that said stem is formed as a spring-biased double-legged member (46) with one leg part (45) connected with a base section (44) of said bracket member for displacement of said base section in the direction of said spring-bias.

10. Supporting means as claimed in claim 1, characterized in that at least one of said bracket members (306) and at least one of said coupling members (307) are provided with electrical contact means (335, 336) to form part of an electrical supply line for electrical drive means incorporated in said screening device.

11. Supporting means as claimed in claim 10, characterized in that said contact means (335, 336) is incorporated in said resilient means (309) and said abutment means (319).

12. Supporting means as claimed in claim 1, characterized in that said coupling member (7; 107; 207; 307; 36) is provided with means (18; 118; 218; 318) facilitating the engagement between the coupling member (7; 107; 207; 307; 36) and the bracket member (6; 106; 206; 306; 406; 24, 29).

13. A skylight window for installation in an inclined roof surface, comprising:

a frame structure composed of top and bottom members (1), as well as side members (2, 26), said frame structure lining an opening in a building; and supporting means for supporting a screening device in the frame structure, comprising a first pair of bracket members (6; 106; 206; 306; 406; 24, 29) for mounting on each of a pair of opposed parallel frame surfaces (2, 26) of said frame structure and a second pair of coupling members (7; 107; 207; 36) each provided with first engaging means (17; 117) enageable by engaging means on said screening device (120), each of said bracket members (6; 106; 206; 306; 406; 24, 29) and each of said coupling members (7; 107; 207; 307; 36) further comprising second engaging means (11–16; 111–116; 33–34, 39–42) for releasable sliding engagement of one of said pair of coupling members with one of said pair of bracket members each member of one of said first and second pairs being provided with a resilient member (9; 109; 209; 309; 409; 31, 32) engageable with an abutment (19; 219; 319; 38) of a member of the other of said first and second pairs to retain a bracket member and a coupling member in mutual engagement, characterized in that the bracket members (6; 106; 206; 306; 406; 24, 29) of said first pair are identical standard members for mounting on said opposed frame surfaces (2, 26), each comprising a relatively flat front part protruding from said frame surface (2, 26) in the mounted position of said bracket member and having a substantially smooth external surface, said second engaging means (11–12; 111–112; 33–34) being formed by a pair of opposed parallel side edges of said front part, and that each coupling member (7; 107; 207; 307; 36) is formed as a substantially flat brick-shaped member provided with an open recess limited by at least one leg portion (13–14; 113–114; 313–314; 41–42) forming engaging means (15–16; 215–216; 315–316; 39–40) engageable with said engaging means on the bracket members.

14. A skylight window as claimed in claim 13, characterized in that it comprises an openable sash structure hingedly connected with said frame structure and that said bracket members (6; 106; 206; 306; 406; 24, 29) are premounted on said side members (2, 26) of said sash structure.

15. A screening device assembly for a skylight window comprising:

a frame structure composed of top and bottom members (1), as well as side members (2, 26), said frame structure lining an opening in a building; and supporting means for supporting a screening device in the frame structure, said means comprising a first pair of bracket members (6; 106; 206; 306; 406; 24, 29) for mounting on each of a pair of opposed parallel frame surfaces (2, 26) of said frame structure and a second pair of coupling members (7; 107; 207; 36) each provided with first engaging means (17; 117) engageable by engaging means on said screening device (120), each of said bracket members (6; 106; 206; 306; 406; 24, 29) and each of said coupling members (7; 107;

207; 307; 36) further comprising second engaging means (11–16; 111–116; 33–34, 39–42) for releasable sliding engagement one of said pairs of coupling members with one of said pairs of bracket members each member of one of said first and second pairs being provided with a resilient member (9; 109; 209; 309; 409; 31, 32) engageable with an abutment means (19; 219; 319; 38) of a member of the other of said first and second pairs to retain a bracket member and a coupling member in mutual engagement, characterized in that the bracket members (6; 106; 206; 306; 406; 24, 29) of said first pair are identical standard members for mounting on said opposed frame surfaces (2, 26), each comprising a relatively flat front part protruding from said frame surface (2, 26) in the mounted position of said bracket member and having a substantially smooth external surface, said second engaging means (11–12; 111–112; 33–34) being formed by a pair of opposed parallel side edges of said front part, and that each coupling member (7; 107; 207; 307; 36) is formed as a substantially flat brick-shaped member provided with an open recess limited by at least one leg portion (13–14; 113–114; 313–314; 41–42) forming engaging means (15–16; 215–216; 315–316; 39–40) engageable with said engaging means on the bracket members, wherein said screening device assembly comprises said pair of coupling members (7; 107; 207; 307; 36) of the supporting means.

16. Supporting means as claimed in claim 5, characterized in that said base section (8, 408) is provided with securing members (20, 21; 420, 421) for securing said bracket member (6, 406) in one of said opposed frame surfaces (2).

* * * * *